US008083570B2

(12) United States Patent
String et al.

(10) Patent No.: US 8,083,570 B2
(45) Date of Patent: Dec. 27, 2011

(54) CHEMICAL MECHANICAL POLISHING PAD HAVING SEALED WINDOW

(75) Inventors: Darrell String, Harve de Grace, MD (US); Jon William Turley, Conshohocken, PA (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 611 days.

(21) Appl. No.: 12/253,385

(22) Filed: Oct. 17, 2008

(65) Prior Publication Data

US 2010/0099344 A1 Apr. 22, 2010

(51) Int. Cl.
*B24B 49/00* (2006.01)
*B24B 1/00* (2006.01)

(52) U.S. Cl. ..... 451/6; 451/41; 451/56; 451/59; 451/283; 451/287; 451/527; 451/530; 451/533; 51/293; 51/297

(58) Field of Classification Search ..... 451/6, 41, 451/56, 59, 63, 283, 285, 287, 526, 527, 451/530, 533, 539; 51/297, 293
See application file for complete search history.

(56) References Cited

U.S. PATENT DOCUMENTS 6,358,130 B1 3/2002 Freeman et al.
6,439,968 B1 8/2002 Obeng
6,464,576 B1 * 10/2002 Freeman et al. ..... 451/533
6,524,164 B1 2/2003 Tolles
6,620,036 B2 * 9/2003 Freeman et al. ..... 451/533
6,884,156 B2 4/2005 Prasad et al.
6,984,163 B2 1/2006 Roberts
7,163,437 B1 1/2007 Swedek et al.
7,201,647 B2 4/2007 Lombardo et al.
7,210,980 B2 * 5/2007 Swedek et ..... 451/6
7,264,536 B2 9/2007 Wiswesser et al.
7,291,063 B2 11/2007 Swisher et al.
2002/0193058 A1 * 12/2002 Carter et al. ..... 451/528
2006/0131273 A1 * 6/2006 Lehman et al. ..... 216/84
2007/0281587 A1 * 12/2007 Wiswesser et al. ..... 451/8
2009/0023363 A1 * 1/2009 Bottema et al. ..... 451/36
* cited by examiner

*Primary Examiner* — Eileen P. Morgan
(74) *Attorney, Agent, or Firm* — Thomas S. Deibert

(57) ABSTRACT

A multilayer chemical mechanical polishing pad is provided, having a polishing layer with a polishing surface, a polishing layer interfacial region parallel to the polishing surface and an outer perimeter; a porous subpad layer with a bottom surface, a porous subpad layer interfacial region parallel to the bottom surface and an outer perimeter; a pressure sensitive adhesive layer; and, a light transmissive window element; wherein the polishing layer interfacial region and the porous subpad layer interfacial region form a coextensive region; wherein the coextensive region secures the polishing layer to the porous subpad layer without the use of a laminating adhesive; wherein the pressure sensitive adhesive layer is applied to the bottom surface of the porous subpad layer; wherein an internal opening extends through the multilayer chemical mechanical polishing pad from the bottom surface to the polishing surface and is bounded by an internal peripheral edge of the porous subpad layer.

10 Claims, 2 Drawing Sheets

CHEMICAL MECHANICAL POLISHING PAD HAVING SEALED WINDOW

The present invention relates generally to the field of polishing pads for chemical mechanical polishing. In particular, the present invention is directed to chemical mechanical polishing pads having an sealed window.

Chemical mechanical planarization, or chemical mechanical polishing (CMP), is a common technique used to planarize or polish workpieces such as semiconductor wafers. In conventional CMP, a wafer carrier, or polishing head, is mounted on a carrier assembly. The polishing head holds the wafer and positions the wafer in contact with a polishing layer of a polishing pad that is mounted on a table or platen within a CMP apparatus. The carrier assembly provides a controllable pressure between the wafer and polishing pad. A polishing medium is optionally dispensed onto the polishing pad and flows into the gap between the wafer and polishing layer. To effect polishing, the polishing pad and wafer typically rotate relative to one another. The wafer surface is polished and made planar by chemical and mechanical action of the polishing layer and polishing medium on the surface.

An important step in planarizing a wafer is determining an endpoint to the process. One popular in situ method for endpoint detection involves providing a polishing pad with a window, which is transparent to select wavelengths of light. During polishing, a light beam is directed through the window to the wafer surface, where it reflects and passes back through the window to a detector (e.g., a spectrophotometer). Based on the return signal, properties of the wafer surface (e.g., the thickness of films) can be determined for endpoint detection. A problem associated with the use of windows in polishing pads involves the leakage of polishing fluid around the window and into a porous subpad layer, which can result in undesirable variability in the polishing properties across the pad surface and during the life of the pad.

One approach to alleviating window leakage in polishing pads is disclosed in U.S. Pat. No. 6,524,164 to Tolles. Tolles discloses a polishing pad for a chemical mechanical polishing apparatus and a method of making the same, wherein the polishing pad has a bottom layer, a polishing surface on a top layer and a transparent sheet of material interposed between the two layers. The transparent sheet is disclosed by Tolles to prevent slurry from the chemical mechanical polishing process from penetrating into the bottom layer of the polishing pad.

To alleviate delamination problems associated with some multilayer polishing pads (i.e., wherein the polishing layer separates from a subpad layer during polishing), some multilayer chemical mechanical polishing pads are constructed by directly bonding a polishing layer to a porous subpad layer, wherein the porous subpad layer is permiable to various polishing media (e.g., slurry) used during polishing. The approach to alleviating window leakage disclosed by Tolles does not lend itself for use with such polishing pads in which the construction does not facilitate the inclusion of an impermiable layer material between the polishing layer and a porous subpad layer.

Another approach to alleviating window leakage in polishing pads is disclosed in U.S. Pat. No. 7,163,437 (Swedek et al.). Swedek et al. disclose a polishing pad that includes a polishing layer having a polishing surface, a backing layer with an aperture and a first portion that is permeable to liquid, and a sealant that penetrates a second portion of the backing layer adjacent to and surrounding the aperture such that the second portion is substantially impermeable to liquid. The second portion into which the sealant material penetrates exhibits a decreased compressibility relative to the rest of the backing layer. Given that the window sealing region is within the polishing track, the same thickness, decreased compressibility second portion acts like a speed bump during polishing operations resulting in an increased potential for the creation of polishing defects.

Accordingly, there is a continuing need for new low defectivity multilayer window polishing pad configurations, wherein window leakage into the subpad layer is alleviated.

In one aspect of the present invention, there is provided a multilayer chemical mechanical polishing pad for polishing a substrate selected from at least one of a magnetic substrate, an optical substrate and a semiconductor substrate; comprising: a polishing layer having a polishing surface, a polishing layer interfacial region parallel to the polishing surface and an outer perimeter; a porous subpad layer having a bottom surface, a subpad layer interfacial region parallel to the bottom surface and an outer perimeter; a pressure sensitive adhesive layer; and, a light transmissive window element; wherein the polishing layer interfacial region and the subpad layer interfacial region form a coextensive region; wherein the coextensive region secures the polishing layer to the porous subpad layer without the use of a laminating adhesive; wherein the pressure sensitive adhesive layer is applied to the bottom surface of the porous subpad layer; wherein an internal opening extends through the multilayer chemical mechanical polishing pad and is bounded by an internal peripheral edge of the porous subpad layer and a corresponding internal peripheral edge of the polishing layer; wherein the light transmissive window element is disposed within the internal opening and contacts the internal peripheral edge of the porous subpad layer; wherein the light transmissive window element is adhered to the pressure sensitive adhesive layer; wherein the porous subpad layer has been subjected to a first critical compressive force along the peripheral edge forming a first irreversibly collapsed, densified region of the porous subpad layer along the internal peripheral edge of the porous subpad layer; wherein the porous subpad layer has been subjected to a second critical compressive force along the outer perimeter of the porous subpad layer forming a second irreversibly collapsed, densified region of the porous subpad layer along the outer perimeter of the porous subpad layer; wherein the polishing surface is adapted for polishing the substrate.

In another aspect of the present invention, there is provided a method for manufacturing a multilayer chemical mechanical polishing pad for polishing a substrate selected from at least one of a magnetic substrate, an optical substrate and a semiconductor substrate; comprising: providing a polishing layer having a polishing surface, a polishing layer interfacial region parallel to the polishing surface and an outer perimeter; providing a porous subpad layer having a bottom surface, a porous subpad interfacial region parallel to the bottom surface, and an outer perimeter; providing a pressure sensitive adhesive layer; providing a light transmissive window element; interfacing the polishing layer and the porous subpad layer forming a stack, wherein the outer perimeter of the polishing layer coincides with the outer perimeter of the porous subpad layer and wherein the polishing layer interfacial region and the porous subpad layer interfacial region form a coextensive region; providing an internal opening that extends through the stack from the bottom surface to the polishing surface and that is bounded by an internal peripheral edge of the porous subpad layer and a corresponding internal peripheral edge of the polishing layer; applying a first critical compressive force to a region of the stack corresponding to the internal peripheral edge of the porous subpad layer, wherein the magnitude of the first critical compressive force is sufficient to form a first irreversibly collapsed, densified region in the porous subpad layer along the peripheral edge; applying a second critical compressive force to a region of the stack corresponding to the outer perimeter of the porous subpad layer, wherein the magnitude of the second critical compressive force is sufficient to form a second irreversibly collapsed, densified region in the porous subpad layer along the outer perimeter of the porous subpad layer; applying the pressure sensitive layer to the bottom surface of the porous subpad layer; and, adhering the light transmissive window element to the pressure sensitive adhesive layer; wherein the light transmissive window element is disposed within the internal opening and contacts the internal peripheral edge of the porous subpad layer; wherein the magnitude of the first and second critical compressive forces is insufficient to cause the irreversible collapse of the polishing layer; and, wherein the polishing surface is adapted for polishing the substrate.

In another aspect of the present invention, there is provided a method of polishing a substrate, comprising: providing a substrate selected from at least one of a magnetic substrate, an optical substrate and a semiconductor substrate; providing a multilayer chemical mechanical polishing pad comprising: a polishing layer having a polishing surface, a polishing layer interfacial region parallel to the polishing surface and an outer perimeter; a porous subpad layer having a bottom surface, a porous subpad layer interfacial region and an outer perimeter; a pressure sensitive adhesive layer; and, a light transmissive window element; wherein the polishing layer interfacial region and the porous subpad layer interfacial region form a coextensive region; wherein the coextensive region secures the polishing layer to the porous subpad layer without the use of a laminating adhesive; wherein the pressure sensitive adhesive layer is applied to the bottom surface of the porous subpad layer; wherein an internal opening extends through the chemical mechanical polishing pad from the bottom surface to the polishing surface and is bounded by an internal peripheral edge of the porous subpad layer and a corresponding internal peripheral edge of the polishing layer; wherein the light transmissive window element is disposed within the internal opening and contacts the internal peripheral edge of the porous subpad layer; wherein the light transmissive window element is adhered to the pressure sensitive adhesive layer; wherein the porous subpad layer has been subjected to a first critical compressive force along the internal peripheral edge of the porous subpad layer forming a first irreversibly collapsed, densified region of the porous subpad layer along the peripheral edge; wherein the porous subpad layer has been subjected to a second critical compressive force along the outer perimeter of the porous subpad layer forming a second irreversibly collapsed, densified region of the porous subpad layer along the outer perimeter of the porous subpad layer; providing a polishing medium at an interface between the polishing surface and the substrate; and, creating dynamic contact at the interface between the polishing surface and the substrate; wherein permeation of the polishing medium into the porous subpad layer is impeded by the polishing layer and the first and second irreversibly collapsed, densified regions.

DETAILED DESCRIPTION

The term "thickness" as used herein and in the appended claims in reference to a multilayer chemical mechanical polishing pad having a polishing surface means the average actual thickness of the multilayer chemical mechanical polishing pad measured in a direction normal to the polishing surface.

The term "polishing medium" as used herein and in the appended claims encompasses particle-containing polishing solutions and non-particle-containing solutions, such as abrasive-free and reactive-liquid polishing solutions.

Figure 1:
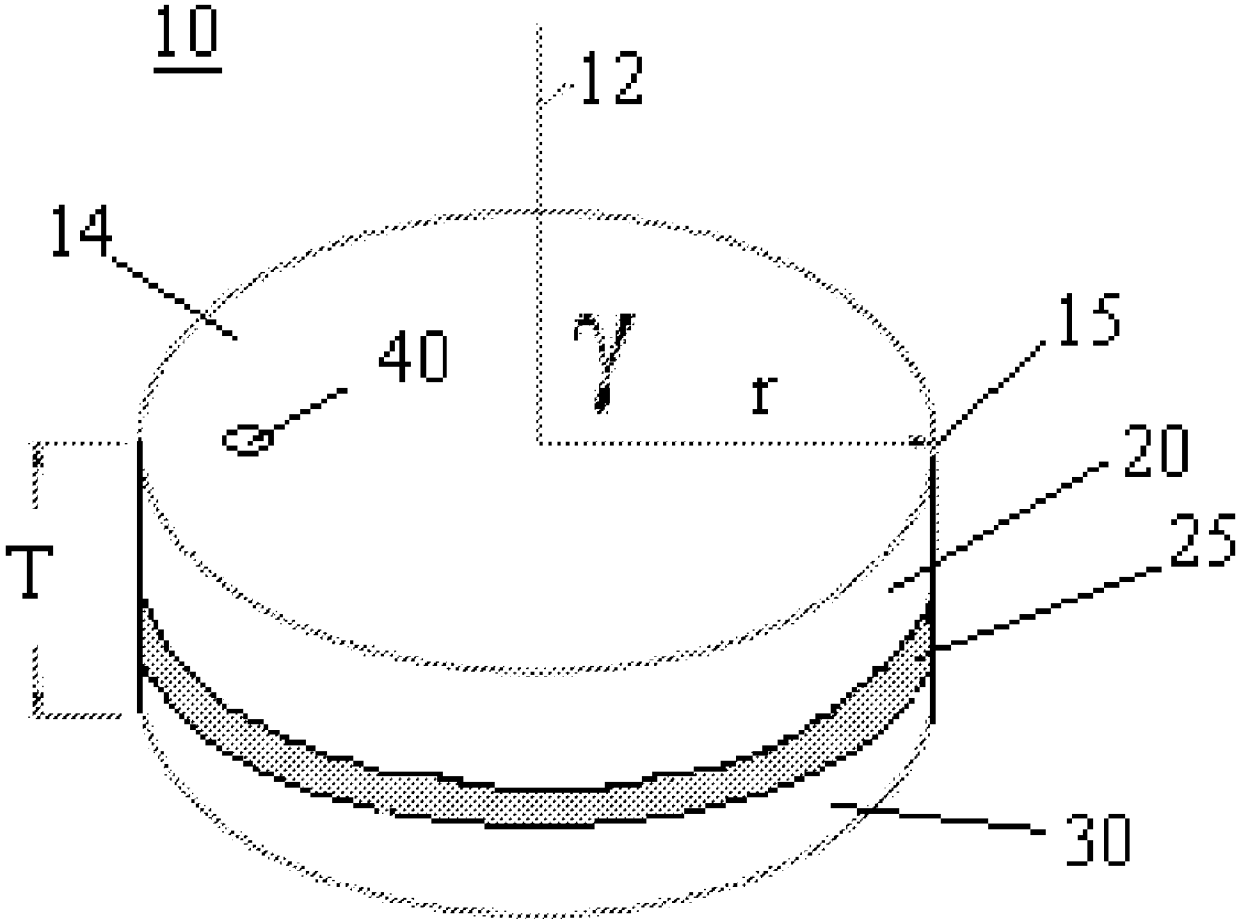
FIG. 1 is a depiction of a perspective view of a multilayer chemical mechanical polishing pad of the present invention.

The term "substantially circular cross section" as used herein and in the appended claims in reference to a multilayer chemical mechanical polishing pad means that the longest radius, r, of the cross section from the central axis to the outer perimeter of the multilayer chemical mechanical polishing pad is ≦20% longer than the shortest radius, r, of the cross section from the central axis to the outer perimeter of the multilayer chemical mechanical polishing pad. (See FIG. 1).

The term "poly(urethane)" as used herein and in the appended claims encompasses (a) polyurethanes formed from the reaction of (i) isocyanates and (ii) polyols (including diols); and, (b) poly(urethane) formed from the reaction of (i) isocyanates with (ii) polyols (including diols) and (iii) water, amines or a combination of water and amines.

The term "crushable porous material" as used herein and in the appended claims refers to a porous material that when subjected to a critical compressive force collapses leaving a densified (i.e., less porous) material.

The term "critical compressive force" as used herein and in the appended claims refers to a compressive force sufficient to collapse a given crushable porous material. One or ordinary skill in the art will understand that the magnitude of the critical compressive force will depend on a variety of factors including the temperature of the crushable porous material. Also, one or ordinary skill in the art will understand that the magnitude of the critical compressive force will depend on the type of force imposed on the crushable porous material (i.e., a static force or a dynamic force).

The term "substantially impermeable to water" as used herein and in the appended claims in reference to the polishing layer means that water dispensed on the polishing surface at atmospheric conditions will not permeate through the polishing layer to the porous subpad layer for at least 24 hours.

The multilayer chemical mechanical polishing pads of the present invention comprise a polishing layer having a polishing surface, a polishing layer interfacial region parallel to the polishing surface and an outer perimeter; a porous subpad layer having a bottom surface, a porous subpad layer interfacial region parallel to the bottom surface and an outer perimeter; a pressure sensitive adhesive layer; and, a light transmissive window element; wherein the polishing layer interfacial region and the porous subpad layer interfacial region form a coextensive region; wherein the coextensive region secures the polishing layer to the porous subpad layer without the use of a laminating adhesive; wherein the pressure sensitive adhesive layer is applied to the bottom surface of the porous subpad layer; wherein an internal opening extends through the chemical mechanical polishing pad and is bounded by an internal peripheral edge of the porous subpad layer and a corresponding internal peripheral edge of the polishing layer; wherein the light transmissive window element is disposed within the internal opening and contacts the internal peripheral edge of the porous subpad layer; wherein the light transmissive window element is adhered to the pressure sensitive adhesive layer; wherein the porous subpad layer has been subjected to a first critical compressive force along the internal peripheral edge of the porous subpad layer forming a first irreversibly collapsed, densified region of the porous subpad layer along (preferably, adjacent to and coincident with) the internal peripheral edge of the porous subpad layer; wherein the porous subpad layer has been subjected to a second critical compressive force along the outer perimeter of the porous subpad layer forming a second irreversibly collapsed, densified region of the porous subpad layer along (preferably, adjacent to) the outer perimeter of the porous subpad layer; wherein the polishing surface is adapted for polishing the substrate. Optionally, the coextensive region comprises a direct bond between the polishing layer and the porous subpad layer, wherein there is substantially no comingling between the layers (i.e., comingled region<0.001% of the average thickness of the multilayer chemical mechanical polishing pad). Preferably, the coextensive region is a comingled region in which there is interpenetration between the polishing layer and the porous sub pad layer, wherein the polishing layer and the porous subpad layer coexist. Preferably, the comingled region comprises 0.001 to 5% of the average total thickness, T, of the multilayer chemical mechanical polishing pad; preferably 0.05 to 5% of the average combined thickness of the polishing layer and the porous subpad layer; more preferably 0.1 to 5% of the average combined thickness of the polishing layer and the porous subpad layer.

In the multilayer chemical mechanical polishing pads of the present invention, a polishing layer is directly bound to a porous subpad layer. That is, the polishing layer is bound to the porous subpad layer without the use of a laminating adhesive. The polishing layer precursor material is deposited directly onto a surface of the porous subpad layer in liquid form. The polishing layer precursor material bonds to the porous subpad layer. The bonding between the polishing layer and the porous subpad layer can be physical, chemical or a combination of both. The polishing layer precursor material can flow into the porous subpad layer before solidifying. The degree of penetration of the precursor material into the porous subpad layer depends on a variety of factors including the system temperature, the viscosity of the precursor material at the system temperature, the open porosity of the porous subpad layer in the porous subpad layer interfacial region, the pressure forcing the precursor material into the porous subpad layer, the kinetics of the reaction of the precursor material (i.e., rate of solidification). The polishing layer precursor material can chemically bond to the porous subpad layer. The degree of chemical bonding formed between the polishing layer precursor material and the porous subpad layer depends on a variety of factors including the composition of each layer and the reactivity between the layers. The precursor material can be applied to the porous subpad layer in one coat. The precursor material can be applied to the porous subpad layer in a plurality of coats.

The polishing layer can comprise a solidified/polymerized material selected from poly(urethane), polysulfone, polyether sulfone, nylon, polyether, polyester, polystyrene, acrylic polymer, polyurea, polyamide, polyvinyl chloride, polyvinyl fluoride, polyethylene, polypropylene, polybutadiene, polyethylene imine, polyacrylonitrile, polyethylene oxide, polyolefin, poly(alkyl)acrylate, poly(alkyl)methacrylate, polyamide, polyether imide, polyketone, epoxy, silicone, EPDM, protein, polysaccharide, polyacetate and combinations of at least two of the foregoing materials. Preferably, the polishing layer comprises a poly(urethane). More preferably, the polishing layer comprises a polyurethane. Preferably, the polishing layer is substantially impermeable to water.

The polishing layer can optionally be produced from an aqueous based fluid precursor material. Aqueous based fluid precursor materials suitable for use with the present invention include, for example, water based urethane dispersions, acrylic dispersions and combinations thereof. The aqueous based fluid precursor material can optionally comprise a water based urethane dispersion (e.g. Witcobond-290H, Witcobond-293, Witcobond-320 and Witcobond-612 available from Chemtura Corporation).

The polishing layer can, optionally, contain a plurality of microelements. Preferably, the plurality of microelements are uniformly dispersed within at least a portion of polishing layer adjacent to and coincident with the polishing surface. The plurality of microelements can be selected from entrapped gas bubbles, hollow core polymeric materials, liquid filled hollow core polymeric materials, water soluble materials and an insoluble phase material (e.g., mineral oil). The plurality of microelements can comprise hollow core polymeric materials. The plurality of microelements can comprise a hollow core copolymer of polyacrylonitrile and polyvinylidene chloride (e.g., Expancel™ from Akso Nobel of Sundsvall, Sweden).

The polishing surface optionally exhibits a macrotexture. Preferably, the macrotexture is designed to alleviate at least one of hydroplaning; to influence polishing medium flow; to modify the stiffness of the polishing layer; to reduce edge effects; and, to facilitate the transfer of polishing debris away from the area between the polishing surface and the substrate. Preferably, the polishing surface exhibits a macrotexture selected from at least one of perforations and grooves. Perforations can extend from the polishing surface part way or all of the way through the thickness of the polishing layer. Grooves can be arranged on the polishing surface such that upon rotation of the pad during polishing, at least one groove sweeps over the substrate. The grooves can optionally be selected from curved grooves, linear grooves and combinations thereof.

The polishing surface optionally comprises a groove pattern. Groove patterns can comprise at least one groove. The at least one groove can be selected from curved grooves, straight grooves and combinations thereof. The groove pattern can be selected from a groove design including, for example, concentric grooves (which may be circular or spiral), curved grooves, cross-hatch grooves (e.g., arranged as an X-Y grid across the pad surface), other regular designs (e.g., hexagons, triangles), tire-tread type patterns, irregular designs (e.g., fractal patterns), and combinations of at least two of the foregoing. The groove pattern can be selected from random, concentric, spiral, cross-hatched, X-Y grid, hexagonal, triangular, fractal and combinations of at least two of the foregoing. The at least one groove can exhibit a groove profile selected from rectangular with straight side-walls or the groove cross-section may be "V"-shaped, "U"-shaped, triangular, saw-tooth, and combinations of at least two of the foregoing. The groove pattern can change across the polishing surface. The groove pattern can be engineered for a specific application. The groove dimensions in a specific groove pattern can be varied across the polishing surface to produce regions of different groove densities.

The at least one groove optionally exhibits a depth of ≧20 mils.

The groove pattern optionally comprises at least two grooves exhibiting a depth of ≧15 mils; a width of ≧10 mils and a pitch of ≧50 mils.

The porous subpad layer comprises a crushable porous material. The porous subpad layer can comprise a material selected from an open cell foam, a woven material, and a nonwoven material (e.g., felted, spunbonded, and needle punched materials). Nonwoven materials suitable for use in the porous subpad layer of the present invention include, for example, polymer impregnated felts (e.g., polyurethane impregnated polyester felts). Woven materials suitable for use in the porous subpad layer of the present invention include, for example, thick flannel materials.

The multilayer chemical mechanical polishing pads of the present invention are designed for use with a polishing medium that is provided at an interface between the polishing surface and a substrate during polishing of the substrate. Permeation of polishing medium into the porous subpad layer during polishing can result in undesirable variability in the polishing properties across the polishing surface and during the life of the polishing pad. To alleviate the potential for polishing medium permeating into the porous subpad layer during polishing, the outer perimeter of the porous subpad layer and the internal peripheral edge of the porous subpad layer are both sealed by a process that irreversibly collapses a portion of the porous subpad layer. The irreversibly collapsed, densified regions in the porous subpad layer exhibit a decreased thickness relative to the rest of the porous subpad layer. That is, the porous subpad layer in the irreversibly collapsed, densified regions has a thickness that is less than the average thickness of the rest of the porous subpad layer (i.e., a reduced thickness, decreased compressibility region). The incorporation of decreased thickness, reduced compressibility regions of the porous subpad layer of the multilayer chemical mechanical polishing pads of the present invention provide sealing without the introduction of the speed bump effect associated with same thickness, decreased compressibility regions created by certain prior art sealing methods. The porous subpad material exhibits an average void volume of 20 to 80%; preferably 50 to 60%. The irreversibly collapsed, densified regions of the porous subpad layer are collapsed to reduce the void volume to ≦20%, preferably ≦10%. The relative difference in the average void volume of the edge sealed region from the average void volume of the rest of the porous subpad layer can be determined using comparative thickness measurements. Optionally, the porous subpad material exhibits an average void volume of 50 to 60% and the first and second irreversibly collapsed, densified regions of the porous subpad layer exhibit a thickness that is ≦75%, more preferably ≦70% of the average thickness of the porous subpad layer.

The light transmissive window element is secured to the multilayer chemical mechanical polishing pad by a pressure sensitive adhesive layer applied to the bottom surface of the porous subpad layer. Preferably, no adhesive is interposed between the light transmissive window element and the internal peripheral edge of the porous subpad layer. The use of an adhesive between the light transmissive window element and the internal peripheral edge of the porous subpad layer could cause an undesirable speed bump effect by permeating into the porous subpad layer adjacent to the internal peripheral edge and modifying the compressibility of the porous subpad layer in that region (i.e., forming a same thickness, reduced compressibility region).

The multilayer chemical mechanical polishing pad of the present invention is optionally adapted to be interfaced with a platen of a polishing machine. Preferably, the multilayer chemical mechanical polishing pad is adapted to be affixed to the platen of a polishing machine. The multilayer chemical mechanical polishing pad can be affixed to the platen using at least one of a pressure sensitive adhesive and vacuum.

The multilayer chemical mechanical polishing pad 10 is optionally adapted for rotation about a central axis 12. (See FIG. 1). Preferably, the polishing surface 14 of polishing layer 20 is in a plane perpendicular to the central axis 12. The multilayer chemical mechanical polishing pad 10 is optionally adapted for rotation in a plane that is at an angle, γ, of 85 to 95° to the central axis 12, preferably, of 90° to the central axis 12. Preferably, the polishing layer 20 has a polishing surface 14 that has a substantially circular cross section perpendicular to the central axis 12. Preferably, the radius, r, of the cross section of the polishing surface 14 perpendicular to the central axis 12 varies by ≦20% for the cross section, more preferably by ≦10% for the cross section.

Figure 2:
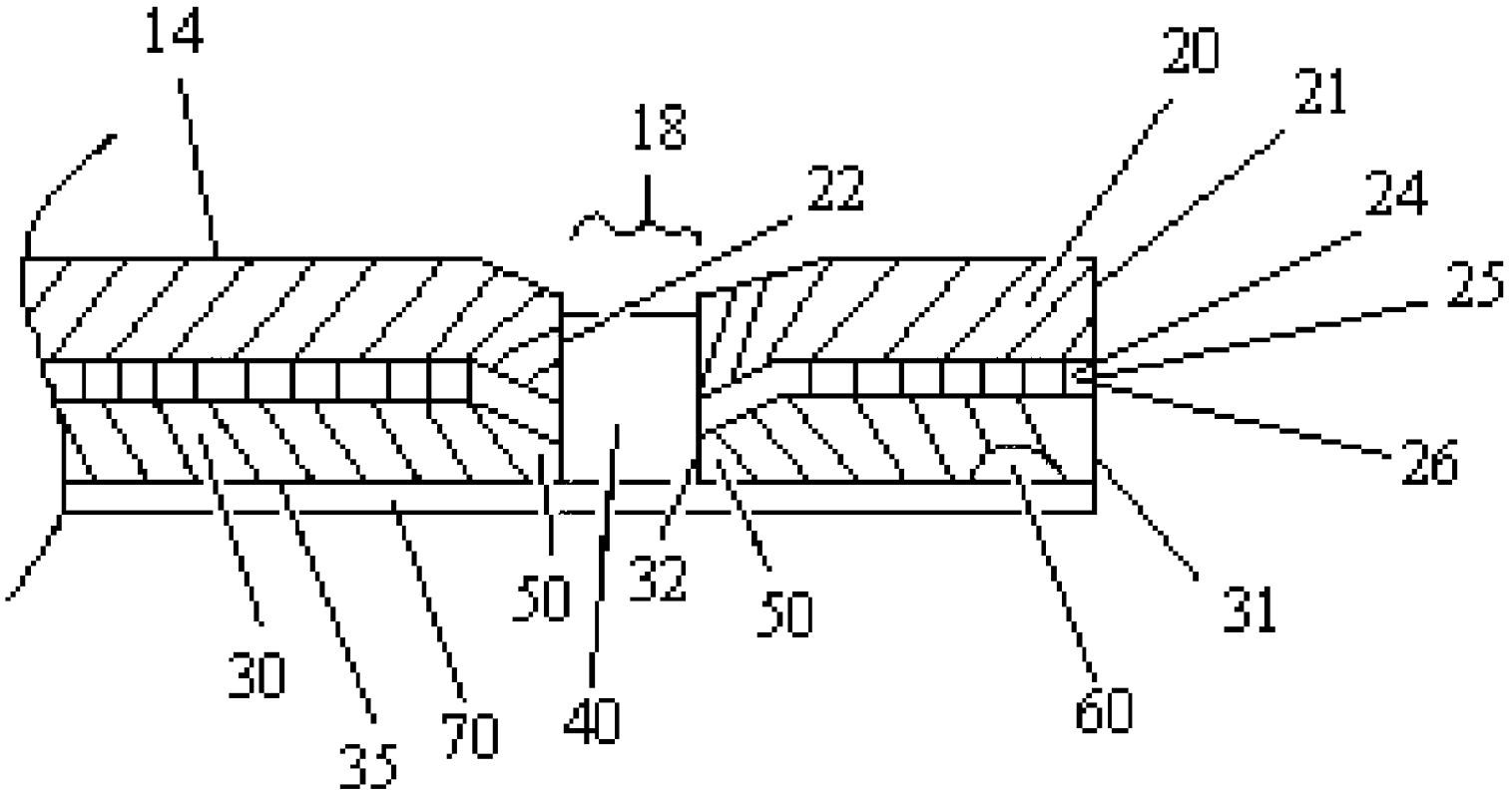
FIG. 2 is a depiction of a cross sectional cut away view of a multilayer chemical mechanical polishing pad of the present invention.

FIG. 2 provides a depiction of a cross sectional cut away view of a preferred multilayer chemical mechanical polishing pad of the present invention. In particular, FIG. 2 provides a view of a polishing layer 20 having a polishing surface 14, a polishing layer interfacial region 24 parallel to the polishing surface and an outer perimeter 21; a porous subpad layer 30 having a bottom surface 35, a porous subpad layer interfacial region 26 parallel to the bottom surface 35 and an outer perimeter 31; a pressure sensitive platen adhesive layer 70; and, a light transmissive window element 40; wherein the polishing layer interfacial region 24 and the porous subpad layer interfacial region 26 form an comingled region 25; wherein the comingled region 25 secures the polishing layer 20 to the porous subpad layer 30 without the use of a laminating adhesive; wherein the pressure sensitive platen adhesive layer 70 is applied to the bottom surface 35 of the porous subpad layer 30; wherein an internal opening 18 extends through the multilayer chemical mechanical polishing pad from the bottom surface 35 to the polishing surface 14 and is bounded by an internal peripheral edge 32 of the porous subpad layer 30 and a corresponding internal peripheral edge 22 of the polishing layer 20; wherein the light transmissive window element 40 is disposed within the internal opening 18 and contacts the internal peripheral edge 32 of the porous subpad layer 30; wherein the light transmissive window element 40 is adhered to the pressure sensitive platen adhesive layer 70; wherein the porous subpad layer 30 has been subjected to a first critical compressive force along the internal peripheral edge 32 forming a first irreversibly collapsed, densified region 50 of the porous subpad layer 30 along the internal peripheral edge 32; wherein the porous subpad layer 30 has been subjected to a second critical compressive force along the outer perimeter 31 of the porous subpad layer 30 forming a second irreversibly collapsed, densified region 60 of the porous subpad layer 30 along the outer perimeter 31 of the porous subpad layer 30; and wherein the polishing surface 14 is adapted for polishing a substrate (not shown).

The multilayer chemical mechanical polishing pad optionally comprises at least one additional layer. Preferably, the at least one additional layer can be selected from a foam, a film, a woven material, and a nonwoven material. The at least one additional layer can optionally be interfaced with the bottom surface of the porous subpad layer by direct bonding or by using an adhesive. The adhesive can be selected from a pressure sensitive adhesive, a hot melt adhesive, a contact adhesive and combinations thereof. Preferably, the adhesive is selected from a pressure sensitive adhesive and a hot melt adhesive. For some polishing operations, the adhesive is preferably a pressure sensitive adhesive. For some polishing operations, the adhesive is preferably a hot melt adhesive.

The method for manufacturing a multilayer chemical mechanical polishing pad of the present invention, comprises: providing a polishing layer having a polishing surface, a polishing layer interfacial region parallel to the polishing surface and an outer perimeter; providing a porous subpad layer having a bottom surface, a porous subpad layer interfacial region parallel to the bottom surface, and an outer perimeter; providing a pressure sensitive adhesive layer; providing a light transmissive window element; interfacing the polishing layer and the porous subpad layer forming a stack, wherein the outer perimeter of the polishing layer extends beyond the outer perimeter of the porous subpad layer or, alternatively, coincides with the outer perimeter of the porous subpad layer and wherein the polishing layer interfacial region and the porous subpad layer interfacial region form a coextensive region; providing an internal opening the extends through the stack from the bottom surface to the polishing surface and is bounded by an internal peripheral edge of the porous subpad layer and a corresponding internal peripheral edge of the polishing layer; applying a first critical compressive force to a region of the stack corresponding to the internal peripheral edge of the porous subpad layer, wherein the magnitude of the first critical compressive force is sufficient to form a first irreversibly collapsed, densified region in the porous subpad layer along the peripheral edge; applying a second critical compressive force to a region of the stack corresponding to the outer perimeter of the porous subpad layer, wherein the magnitude of the second critical compressive force is sufficient to form a second irreversibly collapsed, densified region in the porous subpad layer along the outer perimeter of the porous subpad layer; applying the pressure sensitive adhesive layer to the bottom surface of the porous subpad layer; and, adhering the light transmissive window element to the pressure sensitive adhesive layer; wherein the light transmissive window element is disposed within the internal opening and contacts the internal peripheral edge of the porous subpad layer; wherein the magnitude of the first and second critical compressive force is insufficient to cause the irreversible collapse of the polishing layer; and, wherein the polishing surface is adapted for polishing the substrate. The porous subpad layer can be subjected to the first and second critical compressive forces sequentially, simultaneously or a combination of sequentially and simultaneously. Optionally, the coextensive region is a comingled region.

The method for manufacturing a multilayer chemical mechanical polishing pad of the present invention, optionally, further comprises: providing a mating surface; providing a stamper with raised features corresponding to the first irreversibly collapsed, densified region and the second irreversibly collapsed, densified region; wherein the stack is placed between the mating surface and the stamper; wherein the mating surface and the stamper are pressed together creating the first critical compressive force forming the first irreversibly collapsed, densified region and the second critical compressive force forming the second irreversibly collapsed, densified region in the porous subpad layer.

The method for manufacturing a multilayer chemical mechanical polishing pad of the present invention, optionally, further comprises: providing a mating surface; providing a first stamper with a raised feature corresponding to the first irreversibly collapsed, densified region; providing a second stamper with a raised feature corresponding to the second irreversibly collapsed, densified region; wherein the stack is placed between the mating surface and the first stamper; wherein the mating surface and the first stamper are pressed together creating the first critical compressive force forming the first irreversibly collapsed, densified region in the porous subpad layer; wherein the stack is placed between the mating surface and the second stamper; and wherein the mating surface and the second stamper are pressed together creating the second critical compressive force forming the second irreversibly collapsed, densified region in the porous subpad layer.

The mating surface can be flat. Alternatively, the mating surface can be designed to include features, such as, one or more raised portions or contouring. The features included on the mating surface can be designed to facilitate the formation of the irreversibly collapsed densified regions in the porous subpad layer. The features included on the mating surface can be designed to facilitate manipulation of polishing layer so that the multilayer chemical mechanical polishing pad is biased to lie flatly on the platen of a polishing machine during polishing.

The method for manufacturing a multilayer chemical mechanical polishing pad of the present invention can, optionally, further comprise: heating at least a portion of the porous subpad layer to facilitate the formation of the first and second irreversibly collapsed, densified regions in the porous subpad layer (i.e., using both heat and pressure to form the irreversibly collapsed, densified regions).

In some embodiments of the present invention, radio frequency welding techniques and equipment can be used to facilitate the formation of the first and second irreversibly collapsed, densified regions in the porous subpad layer.

In some embodiments of the present invention, ultrasonic welding techniques and equipment can be used to facilitate the formation of the first and second irreversibly collapsed, densified regions in the porous subpad layer.

In some embodiments of the present invention, the method for manufacturing a multilayer chemical mechanical polishing pad of the present invention, comprises: providing a polishing layer having a polishing surface, a polishing layer interfacial region parallel to the polishing surface and an outer perimeter; providing a porous subpad layer having a bottom surface, a porous subpad layer interfacial region parallel to the bottom surface, and an outer perimeter; providing a pressure sensitive adhesive layer; providing a light transmissive window element; providing a first sealing die; providing a second sealing die; interfacing the polishing layer and the porous subpad layer forming a stack, wherein the outer perimeter of the polishing layer extends beyond the outer perimeter of the porous subpad layer or, alternatively, coincides with the outer perimeter of the porous subpad layer and wherein the polishing layer interfacial region and the porous subpad layer interfacial region form a coextensive region; providing an internal opening that extends through the stack from the bottom surface to the polishing surface and is bounded by an internal peripheral edge of the porous subpad layer and a corresponding internal peripheral edge of the polishing layer; raising a temperature of and applying a first critical compressive force to a region of the stack corresponding to the internal peripheral edge of the porous subpad layer using the first sealing die, wherein the raised temperature and the magnitude of the first critical compressive force are collectively sufficient to form a first irreversibly collapsed, densified region in the porous subpad layer along the internal peripheral edge; raising a temperature of and applying a second critical compressive force to a region of the stack corresponding to the outer perimeter of the porous subpad layer using the second sealing die, wherein the raised temperature and the magnitude of the second critical compressive force are collectively sufficient to form a second irreversibly collapsed, densified region in the porous subpad layer along the outer perimeter of the porous subpad layer; applying the pressure sensitive layer to the bottom surface of the porous subpad layer; and, adhering the light transmissive window element to the pressure sensitive adhesive layer; wherein the light transmissive window element is disposed within the internal opening in the porous subpad layer and contacts the internal peripheral edge of the porous subpad layer; wherein the magnitude of the first and second critical compressive force is insufficient to cause the irreversible collapse of the polishing layer; and, wherein the polishing surface is adapted for polishing the substrate. In some aspects of these embodiments, the coextensive region is a comingled region. In some aspects of these embodiments, the first and second sealing dies are each individually selected from a radio frequency sealing die and an ultrasonic sealing die. In some aspects of these embodiments, the first and second sealing dies are both radio frequency sealing dies. In some aspects of these embodiments, the first and second sealing dies are both ultrasonic sealing dies.

In some embodiments of the present invention, the method for manufacturing a multilayer chemical mechanical polishing pad of the present invention, comprises: providing a polishing layer having a polishing surface, a polishing layer interfacial region parallel to the polishing surface and an outer perimeter; providing a porous subpad layer having a bottom surface, a porous subpad layer interfacial region parallel to the bottom surface, and an outer perimeter; providing a pressure sensitive adhesive layer; providing a light transmissive window element; providing a sealing die; interfacing the polishing layer and the porous subpad layer forming a stack, wherein the outer perimeter of the polishing layer extends beyond the outer perimeter of the porous subpad layer or, alternatively, coincides with the outer perimeter of the porous subpad layer and wherein the polishing layer interfacial region and the porous subpad layer interfacial region form a coextensive region; providing an internal opening that extends through the stack from the bottom surface to the polishing surface and is bounded by an internal peripheral edge of the porous subpad layer and a corresponding internal peripheral edge of the polishing layer; raising a temperature of and applying a critical compressive force to a first region of the stack corresponding to the internal peripheral edge of the porous subpad layer and to a second region of the stack corresponding to the outer perimeter of the porous subpad layer using the sealing die, wherein the raised temperature and the magnitude of the critical compressive force are collectively sufficient to form a first irreversibly collapsed, densified region in the porous subpad layer in the first region corresponding to the internal peripheral edge and a second irreversibly collapsed, densified region in the porous subpad layer in the second region corresponding to the outer perimeter; applying the pressure sensitive layer to the bottom surface of the porous subpad layer; and, adhering the light transmissive window element to the pressure sensitive adhesive layer; wherein the light transmissive window element is disposed within the internal opening in the porous subpad layer and contacts the internal peripheral edge of the porous subpad layer; wherein the magnitude of the critical compressive force is insufficient to cause the irreversible collapse of the polishing layer; and, wherein the polishing surface is adapted for polishing the substrate. In some aspects of these embodiments, the coextensive region is a comingled region. In some aspects of these embodiments, the pressure sensitive adhesive layer is applied to the bottom surface of the porous subpad layer before application of the critical compressive force. In some aspects of these embodiments, the pressure sensitive adhesive layer is applied to the bottom surface of the porous subpad layer after application of the critical compressive force. In some aspects of these embodiments, the sealing die is selected from a radio frequency sealing die and an ultrasonic sealing die. In some aspects of these embodiments, the sealing die is a radio frequency sealing die. In some aspects of these embodiments, the sealing die is an ultrasonic sealing die.

The method of the present invention for polishing a substrate, comprises: providing a substrate selected from at least one of a magnetic substrate, an optical substrate and a semiconductor substrate; providing a multilayer chemical mechanical polishing pad comprising: a polishing layer having a polishing surface, a polishing layer interfacial region parallel to the polishing surface and an outer perimeter; a porous subpad layer having a bottom surface, a porous subpad layer interfacial region and an outer perimeter; a pressure sensitive adhesive layer; and, a light transmissive window element; wherein the polishing layer interfacial region and the porous subpad layer interfacial region form a coextensive region; wherein the coextensive region secures the polishing layer to the porous subpad layer without the use of a laminating adhesive; wherein the pressure sensitive adhesive layer is applied to the bottom surface of the porous subpad layer; wherein an internal opening extends through the multilayer chemical mechanical polishing pad from the bottom surface to the polishing surface and is bounded by an internal peripheral edge of the porous subpad layer and a corresponding internal peripheral edge of the polishing layer; wherein the light transmissive window element is disposed within the internal opening and contacts the internal peripheral edge of the porous subpad layer; wherein the light transmissive window element is adhered to the pressure sensitive adhesive layer; wherein the porous subpad layer has been subjected to a first critical compressive force along the internal peripheral edge of the porous subpad layer forming a first irreversibly collapsed, densified region of the porous subpad layer along the peripheral edge; wherein the porous subpad layer has been subjected to a second critical compressive force along the outer perimeter of the porous subpad layer forming a second irreversibly collapsed, densified region of the porous subpad layer along the outer perimeter of the porous subpad layer; providing a polishing medium at an interface between the polishing surface and the substrate; and, creating dynamic contact at the interface between the polishing surface and the substrate; wherein permeation of the polishing medium into the porous subpad layer is impeded by the polishing layer and the first and second irreversibly collapsed, densified regions. Optionally, the coextensive region is a comingled region. Any permeation of the polishing medium into the porous subpad layer is impeded to the point that it does not negatively affect the polishing performance of the multilayer chemical mechanical polishing pad. Preferably, permeation of the polishing medium into the porous subpad layer is precluded by the polishing layer and the first and second irreversibly collapsed, densified regions under the polishing conditions used to polish the substrate.

Preferably, the method of the present invention for polishing a substrate further comprises: providing a light source; providing a light detector; providing a control system; wherein the light source directs light through the light transmissive window element in the multilayer chemical mechanical polishing pad incident on the substrate; wherein the light detector detects light reflected from the substrate; wherein the control system receives an input from the light detector and determines when a polishing endpoint is reached.

We claim:

1. A multilayer chemical mechanical polishing pad for polishing a substrate selected from at least one of a magnetic substrate, an optical substrate and a semiconductor substrate; comprising:

a polishing layer having a polishing surface, an outer perimeter and a polishing layer interfacial region parallel to the polishing surface;

a porous subpad layer having a bottom surface, an outer perimeter and a porous subpad layer interfacial region parallel to the bottom surface;

a pressure sensitive adhesive layer; and, a light transmissive window element;

wherein the polishing layer interfacial region and the porous subpad layer interfacial region form a coextensive region;

wherein the coextensive region secures the polishing layer to the porous subpad layer without the use of a laminating adhesive;

wherein the pressure sensitive adhesive layer is applied to the bottom surface of the porous subpad layer;

wherein an internal opening extends through the multilayer chemical mechanical polishing pad from the bottom surface to the polishing surface and is bounded by an internal peripheral edge of the porous subpad layer and a corresponding internal peripheral edge of the polishing layer;

wherein the light transmissive window element is disposed within the internal opening and contacts the internal peripheral edge of the porous subpad layer;

wherein the light transmissive window element is adhered to the pressure sensitive adhesive layer;

wherein the porous subpad layer has been subjected to a first critical compressive force along the internal peripheral edge forming a first irreversibly collapsed, densified region of the porous subpad layer along the peripheral edge;

wherein the porous subpad layer has been subjected to a second critical compressive force along the outer perimeter of the porous subpad layer forming a second irreversibly collapsed, densified region of the porous subpad layer along the outer perimeter of the porous subpad layer;

wherein the polishing surface is adapted for polishing the substrate.

2. The multilayer chemical mechanical polishing pad of claim 1, with the proviso that no adhesive is interposed between the peripheral edge of the porous subpad layer and the light transmissive window element.

3. The multilayer chemical mechanical polishing pad of claim 2, wherein the polishing surface is adapted for polishing the substrate through the incorporation of macrotexture to facilitate polishing the substrate, wherein the macrotexture comprises at least one of perforations and grooves.

4. The multilayer chemical mechanical polishing pad of claim 2, wherein the porous subpad layer comprises an open cell foam material.

5. The multilayer chemical mechanical polishing pad of claim 2, wherein the porous subpad layer comprises a polyurethane impregnated polyester felt.

6. The multilayer chemical mechanical polishing pad of claim 2, wherein the polishing layer comprises an aqueous urethane polymer and hollow sphere polymeric microelements.

7. The multilayer chemical mechanical polishing pad of claim 2, wherein the coextensive region is a commingled region.

8. A method for manufacturing a multilayer chemical mechanical polishing pad for polishing a substrate selected from at least one of a magnetic substrate, an optical substrate and a semiconductor substrate; comprising:

providing a polishing layer having a polishing surface, an outer perimeter and a polishing layer interfacial region parallel to the polishing surface;

providing a porous subpad layer having a bottom surface, an outer perimeter and a porous subpad layer interfacial region parallel to the bottom surface;

providing a pressure sensitive adhesive layer;

providing a light transmissive window element;

interfacing the polishing layer and the porous subpad layer forming a stack, wherein the outer perimeter of the polishing layer coincides with the outer perimeter of the porous subpad layer and wherein the polishing layer interfacial region and the porous subpad layer interfacial region form a coextensive region;

providing an internal opening the extends through the stack from the bottom surface to the polishing surface, wherein the internal opening is bounded by an internal peripheral edge of the porous subpad layer and a corresponding internal peripheral edge of the polishing layer;

applying a first critical compressive force to a region of the stack corresponding to the internal peripheral edge of the porous subpad layer, wherein the magnitude of the first critical compressive force is sufficient to form a first irreversibly collapsed, densified region in the porous subpad layer along the peripheral edge;

applying a second critical compressive force to a region of the stack corresponding to the outer perimeter of the porous subpad layer, wherein the magnitude of the second critical compressive force is sufficient to form a second irreversibly collapsed, densified region in the porous subpad layer along the outer perimeter of the porous subpad layer;

applying the pressure sensitive layer to the bottom surface of the porous subpad layer; and, adhering the light transmissive window element to the pressure sensitive adhesive layer, wherein the light transmissive window element is disposed within the internal opening and contacts the internal peripheral edge of the porous subpad layer;

wherein the magnitude of the first and second critical compressive forces is insufficient to cause the irreversible collapse of the polishing layer; and, wherein the polishing surface is adapted for polishing the substrate.

9. The method of claim 8, further comprising:

providing a mating surface;

providing a first stamper with a raised feature corresponding to the first irreversibly collapsed, densified region;

providing a second stamper with a raised feature corresponding to the second irreversibly collapsed, densified region;

wherein the stack is placed on the mating surface and the first stamper is pressed against the stack creating the first critical compressive force forming the first irreversibly collapsed, densified region in the porous subpad layer; and, wherein the stack is placed on the mating surface and the second stamper is pressed against the stack creating the second critical compressive force forming the second irreversibly collapsed, densified region in the porous subpad layer.

10. A method of polishing a substrate, comprising:

providing a substrate selected from at least one of a magnetic substrate, an optical substrate and a semiconductor substrate;

providing a multilayer chemical mechanical polishing pad comprising: a polishing layer having a polishing surface, an outer perimeter and a polishing layer interfacial region parallel to the polishing surface; a porous subpad layer having a bottom surface, an outer perimeter and a porous subpad layer interfacial region; a pressure sensitive adhesive layer; and, a light transmissive window element; wherein the polishing layer interfacial region and the porous subpad layer interfacial region form a coextensive region; wherein the coextensive region secures the polishing layer to the porous subpad layer without the use of a laminating adhesive; wherein the pressure sensitive adhesive layer is applied to the bottom surface of the porous subpad layer; wherein an internal opening extends through the chemical mechanical polishing pad from the bottom surface to the polishing surface and is bounded by an internal peripheral edge of the porous subpad layer and a corresponding internal peripheral edge of the polishing layer; wherein the light transmissive window element is disposed within the internal opening and contacts the internal peripheral edge of the porous subpad layer; wherein the light transmissive window element is adhered to the pressure sensitive adhesive layer; wherein the porous subpad layer has been subjected to a first critical compressive force along the internal peripheral edge of the porous subpad layer forming a first irreversibly collapsed, densified region of the porous subpad layer along the peripheral edge; wherein the porous subpad layer has been subjected to a second critical compressive force along the outer perimeter of the porous subpad layer forming a second irreversibly collapsed, densified region of the porous subpad layer along the outer perimeter of the porous subpad layer;

providing a polishing medium at an interface between the polishing surface and the substrate; and, creating dynamic contact at the interface between the polishing surface and the substrate; wherein permeation of the polishing medium into the porous subpad layer is impeded by the polishing layer and the first and second irreversibly collapsed, densified regions.

* * * * *